US006543772B1

(12) United States Patent
Bourdow

(10) Patent No.: US 6,543,772 B1
(45) Date of Patent: Apr. 8, 2003

(54) MULTIPLE LEVEL CHECKERS GAME

(76) Inventor: Michael J. Bourdow, 471 E. School St., Frankenmuth, MI (US) 48734

( * ) Notice: Subject to any disclaimer, the term of this patent is extended or adjusted under 35 U.S.C. 154(b) by 0 days.

(21) Appl. No.: 10/118,483

(22) Filed: Apr. 8, 2002

(51) Int. Cl.[7] ..... A63F 3/00
(52) U.S. Cl. ..... 273/260; 273/241; 273/287
(58) Field of Search ..... 273/241, 242, 273/258, 260, 261, 284, 287

(56) References Cited

U.S. PATENT DOCUMENTS

| | | | | |
|---|---|---|---|---|
| 3,399,895 | A | 9/1968 | Beach | |
| D223,540 | S | 5/1972 | Kayle | |
| 3,767,201 | A | 10/1973 | Harper et al. | |
| 3,937,471 | A | 2/1976 | Brennan | |
| 4,333,654 | A | 6/1982 | Allain | |
| 4,883,278 | A | 11/1989 | Scott | |
| 5,033,751 | A | 7/1991 | Ching | |
| 5,112,056 | A | 5/1992 | Ching | |
| 5,338,040 | A | 8/1994 | Cutler | |
| 5,443,268 | A | 8/1995 | Mayfield et al. | |
| 5,556,099 | A | 9/1996 | Mardirosian | |
| 5,794,932 | A | 8/1998 | Gastone | |
| 6,189,887 | B1 * | 2/2001 | Dommasch | 273/236 |
| 6,276,687 | B1 | 8/2001 | Lenhart | |

* cited by examiner

*Primary Examiner*—Paul T. Sewell
*Assistant Examiner*—V K Mendiratta
(74) *Attorney, Agent, or Firm*—Reising, Ethington, Barnes, Kisselle, Learman & McCulloch, P.C.

(57) ABSTRACT

A method of playing a multi-level board game provides at least three playing levels with each playing level constituting a separate playing surface. The playing surfaces are divided into a plurality of rows, wherein each row has a plurality of alternating playing and non-playing squares. The adjacent rows have their playing and non-playing squares offset from one another forming a diagonal between the playing squares of adjacent rows. Each playing surface has an identical arrangement of playing and non-playing squares. Two sets of game pieces are provided and arranged at opposite ends of the playing surfaces so that each playing surface has an identical arrangement of game pieces. The game pieces have non-capturing and capturing movement provisions within a playing level restricting each game piece to moving diagonally from a playing square to another playing square within the playing level. Additional non-capturing and capturing moves are provided between adjacent playing levels wherein a game piece can move from a playing square on one playing level to an identically arranged playing square on another playing level.

14 Claims, 5 Drawing Sheets

MULTIPLE LEVEL CHECKERS GAME

BACKGROUND OF THE INVENTION

1. Field of the Invention

The invention relates generally to a multi-level checkerboard game and method of play.

2. Related Art

Draughts is an ancient game, the origins of which, are not completely clear. However, early references to Draughts are found as early as 1600 B.C. in Egyptian paintings. The game of Draughts has historically been played on a single two-dimensional playing surface, with the exact arrangement of the playing surface changing over time. It was not until about 1100, possibly in the south of France, when the game was played on a chessboard. During this time, the game was played with twelve pieces on each side of the board and remains customary in the United States today. It was not until the early 1700's that the game of Draughts came from England to America and subsequently adopted the name Checkers.

Still today, the game of checkers remains largely a single level two-dimensional game. The board typically is an 8×8 arrangement of alternating playing and non-playing squares. Opponents each have a set of game pieces with each set having twelve game pieces arranged on opposite ends of a board. The game pieces take up three rows on opposite ends and are placed on alternating playing squares. The rules have remained standardized since being introduced in America, and consist primarily of moving game pieces diagonally in a forward direction until a piece has reached the opposite end of the board to be crowned "king". A "king" can move backward diagonally as well as forward providing additional mobility to the game piece. To capture an opponent, a player jumps the opponent, thus "capturing" his game piece. A player wins when they are the last player with game pieces remaining, or are the last player able to move game pieces.

SUMMARY OF THE INVENTION

A method of playing a multi-level board game provides at least three playing levels with each playing level constituting a separate playing surface. The playing surfaces are divided into a plurality of rows, wherein each row has a plurality of alternating playing and non-playing squares. The adjacent rows have their playing and non-playing squares offset from one another forming a diagonal between the playing squares of adjacent rows. Each playing surface has an identical arrangement of playing and non-playing squares. Two sets of game pieces are provided and arranged at opposite ends of the playing surfaces so that each playing surface has an identical arrangement of game pieces. The game pieces have non-capturing movement provisions within a playing level restricting each game piece to moving diagonally from a playing square to an adjacent playing square. Capturing movement provisions within a playing level allow a game piece to move diagonally along a straight line from a playing square, over an opponent's game piece positioned on an adjacent playing square, to a vacant playing square adjacent the opponent's game piece. Additional non-capturing moves are provided between adjacent playing levels wherein a game piece can move from a playing square on one level to an identically arranged playing square on an adjacent level. Additional capturing moves are provided between playing levels wherein a game piece can move from a playing square on one level, over an opponent's game piece positioned on an identically arranged playing square of an adjacent playing level, to an identically arranged playing square on a playing level adjacent the opponent's game piece.

One advantage of the invention is that by providing at least three playing levels, additional maneuvers of the game pieces are made possible.

Another advantage of the invention is that by providing additional maneuvers to the game pieces, an added complexity is added to the game.

Another advantage of the invention is that the additional maneuvers of the game pieces can be easily and quickly learned.

Another advantage of the invention is that the complexity of the game can be increased simply by adding additional playing levels.

Another advantage of the invention is that a more challenging game is provided by having additional playing levels and additional maneuverability of the game pieces, thus providing a board game more capable of sustaining a player's interest.

It should be recognized that the above list of objects, features, and advantages is in no way comprehensive, and that others will be appreciated by those skilled in the art.

BRIEF DESCRIPTION OF THE DRAWINGS

These and other features and advantages of the preferred embodiment of the present invention will become more readily appreciated when considered in connection with the following detailed description and appended drawings, wherein.

DETAILED DESCRIPTION OF A PREFERRED EMBODIMENT

A method of playing a multi-level board game 10 provides added maneuverability of game pieces, thus providing an added lure of complexity and challenge to maintain a player's interest. The board game 10 provides at least three playing levels 12, 14, 16 with two sets of game pieces 18, 19 arranged at opposite ends of the playing levels 12, 14, 16. The game pieces 18, 19 are assigned non-capturing and capturing movement provisions which allow the game pieces 18, 19 to move within a playing level and between playing levels. The movement provisions incorporate generally the movements from a standard checkers game, plus additional movement provisions providing the game pieces added maneuverability to move between playing levels 12, 14, 16.

Figure 1:
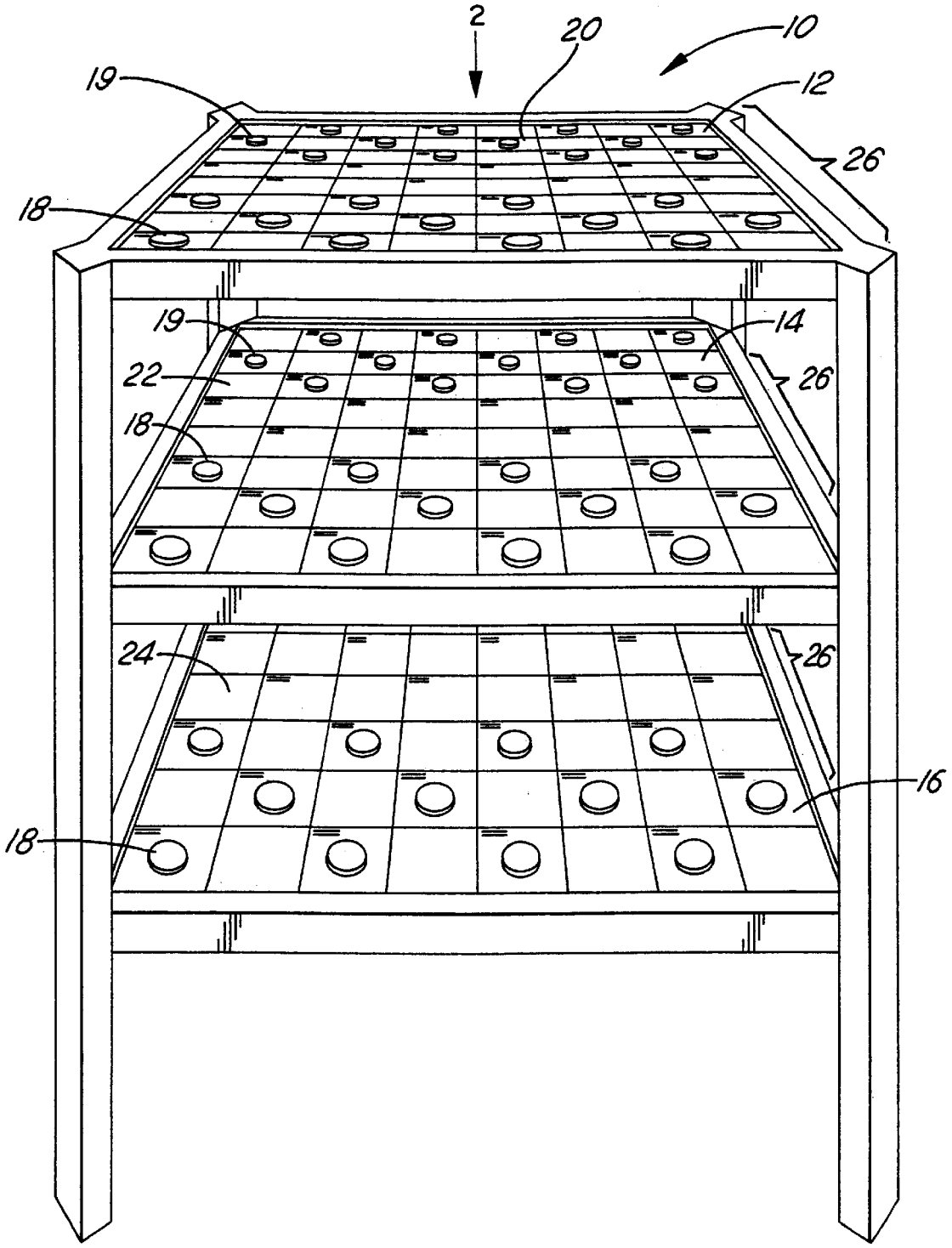
FIG. 1 is a perspective view of a multi-level board game representing a preferred embodiment of the current invention.

The multi-level board game 10 has at least three playing levels, and is shown here in a preferred embodiment in FIG. 1 having three playing levels 12, 14, 16 stacked in spaced relation above one another. Though the playing levels 12, 14, 16 are shown stacked above one another, it should be recognized that this is not necessary and that the playing levels 12, 14, 16 could just as well be arranged separately from one another (not shown here). Each playing level 12, 14, 16 constitutes a separate playing surface 20, 22, 24 that is divided into a plurality of rows, shown here as having eight rows 26. Each row 26 has a plurality of alternating playing squares 28 and non-playing squares 30. The playing and non-playing squares 28, 30 of one row 26 are offset from the playing and non-playing squares 28, 30 of an adjacent row 26 providing for a diagonal between playing squares 28 of adjacent rows 26, along which the players move the game pieces 18, 19. Each row 26 is shown here having eight squares, thereby providing four playing squares 28 and four non-playing squares 30 in each row 26. It should be recognized that the number of rows incorporated in a playing surface need not be limited to having eight rows and the number of squares per row need not be limited to eight. The playing surfaces 20, 22, 24 as shown are arranged similarly to a checkers board that is well-known in the U.S. today, having an eight by eight configuration for a total of sixty-four squares.

Each playing surface 20, 22, 24 has an identical arrangement of playing and non-playing squares 28, 30, and are preferably transparent. The transparency allows a player to see through one playing surface to another playing surface to facilitate the player's ability to see the entire arrangement of game pieces 18, 19 on the playing surfaces 20, 22, 24. It should be understood however, that the playing surfaces 20, 22, 24 need not be transparent, and that the transparency represents only a preferred embodiment of the current invention.

Figure 2:
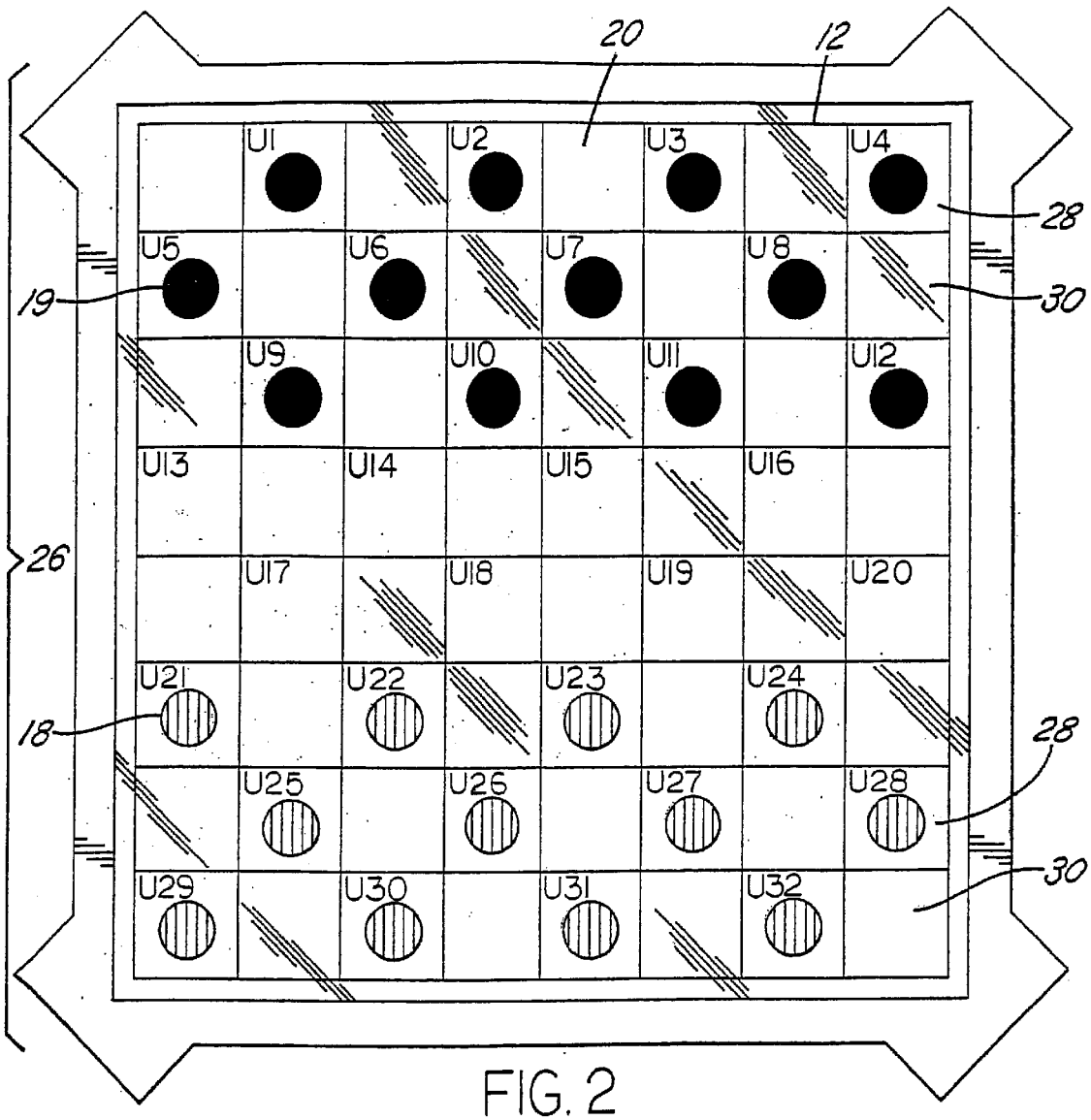
FIG. 2 is a plan view looking in the direction of Arrow 2 in FIG. 1 showing an arrangement of game pieces on a playing level of the multi-level board game.

As shown in FIG. 2, the playing squares 28 on the playing surface 20 are preferably numbered sequentially, with each playing level 12, 14, 16 having playing squares 28 numbered in an identical sequence. Preferably, each playing level 12, 14, 16 is designated by a prefix of the playing square number, such that the lower level 16 is designated by an L before the playing square number, the middle level 14 is designated by an M before the playing square number, and the upper level 12 is designated by a U before the playing square number. The prefix designation facilitates identification of the playing square in the case where the playing levels 12, 14, 16 are either separate and in a non-stacked relation from one another (not shown), or when a player is verbally communicating a playing square location to an opponent. It should be recognized that the non-playing squares 30 could be sequentially numbered as well, or given some other identifying designation, though this is not shown here.

Two sets of game pieces 18, 19 are provided wherein each set preferably has twelve pieces for each playing level 12, 14, 16. To facilitate differentiating one set from another, preferably each set is a different color, or as shown here, one set 18 being red in color and the other set 19 being black in color. Each set 18, 19 is preferably arranged at opposite ends of each playing surface 20, 22, 24 so that each playing surface 20, 22, 24 has an identical arrangement of game pieces. As best shown in FIG. 2, the game pieces 18, 19 are arranged in the first three rows at opposite ends of the playing surfaces 20, 22, 24 so that each of the first three rows has four game pieces. This arrangement of game pieces is the arrangement that is typically used in checkers as played in the United States. It should be recognized however, that when a different number of playing squares are incorporated in a row of a playing surface, or a different number of game pieces are used, the arrangement of game pieces on a playing surface may be different than as shown here. With the game pieces 18, 19 arranged on the three separate playing surfaces 20, 22, 24, each playing surface 20, 22, 24 looks alike, and the game 10 is set to be commenced.

INSTRUCTIONS

Figure 3:
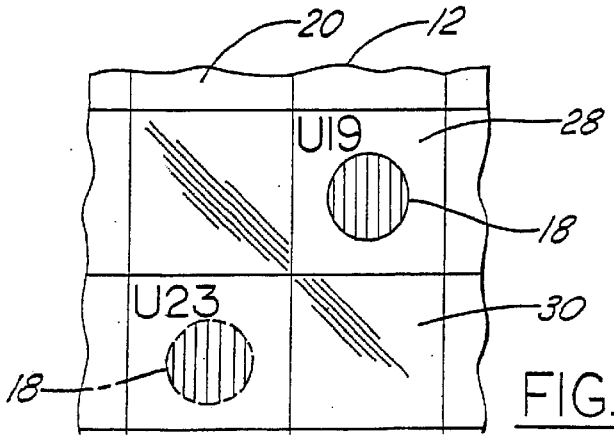
FIGS. 3–7 are partial plan views showing various movements of the game pieces within and among the levels.

To initiate play of the game 10, a player moves a game piece 18, 19 from any one of the three levels 12, 14, 16 in a diagonally forward non-capturing movement, as best shown in FIG. 3. A game piece 18, 19, prior to reaching the opposite side of a playing surface 20, 22, 24, is restricted to moving in a diagonally forward direction from one playing square 28 to an adjacent playing square 28. After the initial move is made by one player, the opposing player makes a move and the play continues with the players taking alternate turns.

Figure 4:
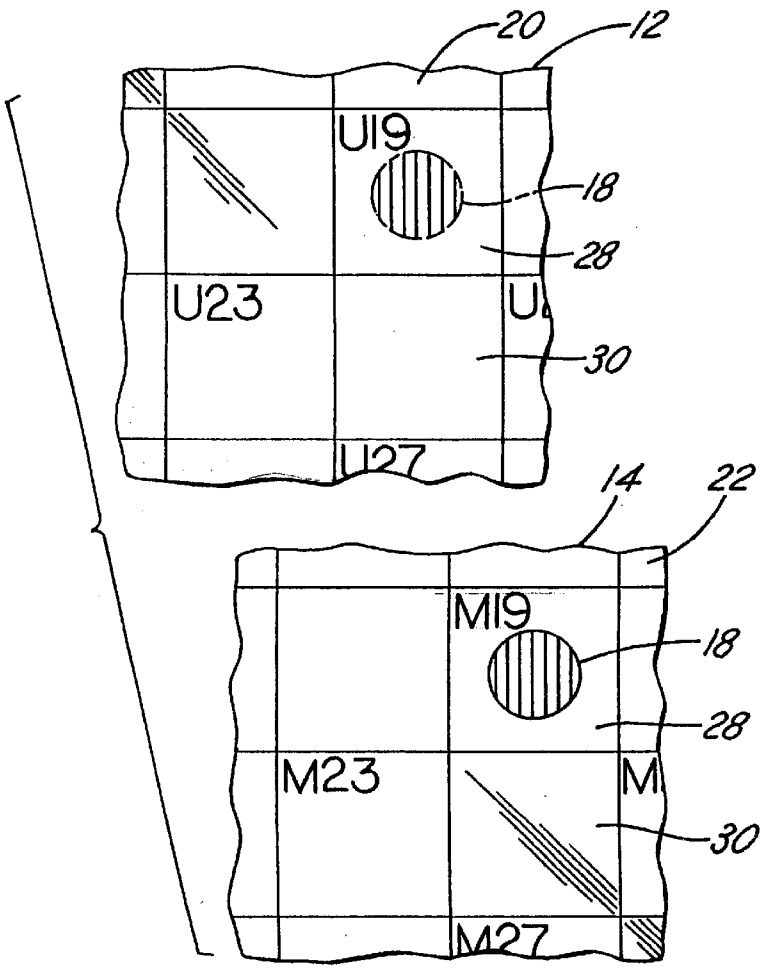

In addition to making a non-capturing move within a single playing level, a player may make a non-capturing move between playing levels 12, 14, 16. As shown in FIG. 4, a non-capturing move entails moving a game piece 18 (shown only as an example) from a playing square 28 of one playing level 12 to an identically numbered playing square 28 of an adjacent playing level 14. For example, a player may move a game piece 18, 19 in a non-capturing move between the lower and middle playing levels 16, 14, or between the upper and middle playing levels 12, 14. It should be understood that in order for a player to make a non-capturing move between playing levels, the playing square 28 in which the player is moving to must be vacant, as is the case with all maneuvers.

Figure 5:
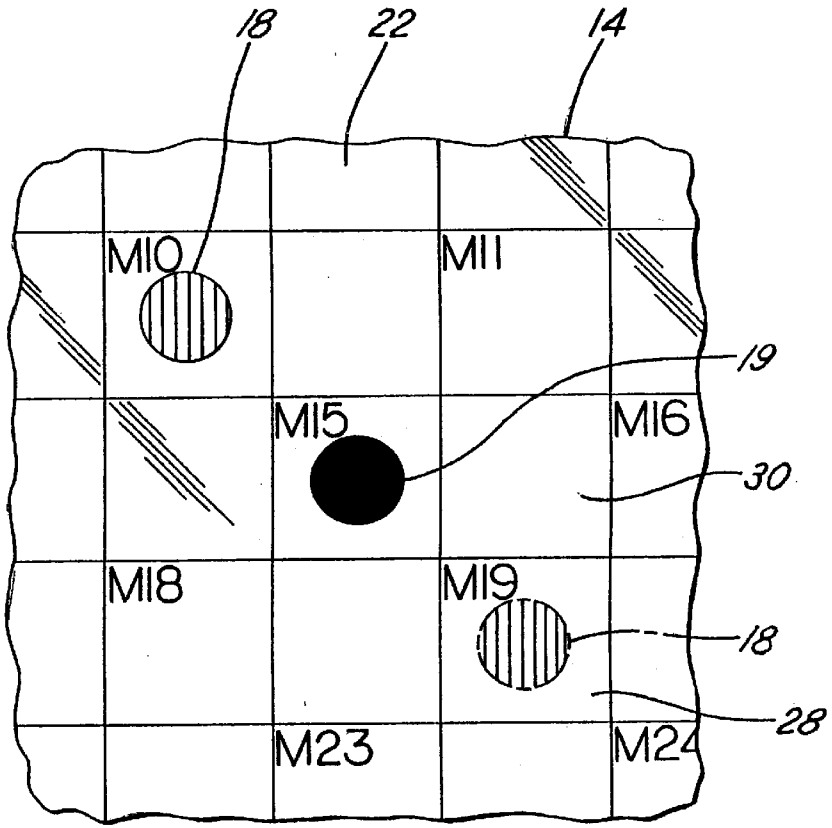

A capturing maneuver may be made by a player within a single level when the player making the move has a game piece 18, 19 on a playing square 20 adjacent a playing square 20 having an opponent's game piece 18, 19. As best shown in FIG. 5, the player's game piece 18 (shown only as an example) is moved along a straight diagonal from one playing square 20, jumping the opponent's game piece 19, and positioned on the playing square 20 along the diagonal immediately adjacent the opponent's game piece 19. Upon making the capturing maneuver, the player removes the opponent's game piece 19 from the playing surface 22, thus capturing the opponent's game piece 19.

Figure 6:
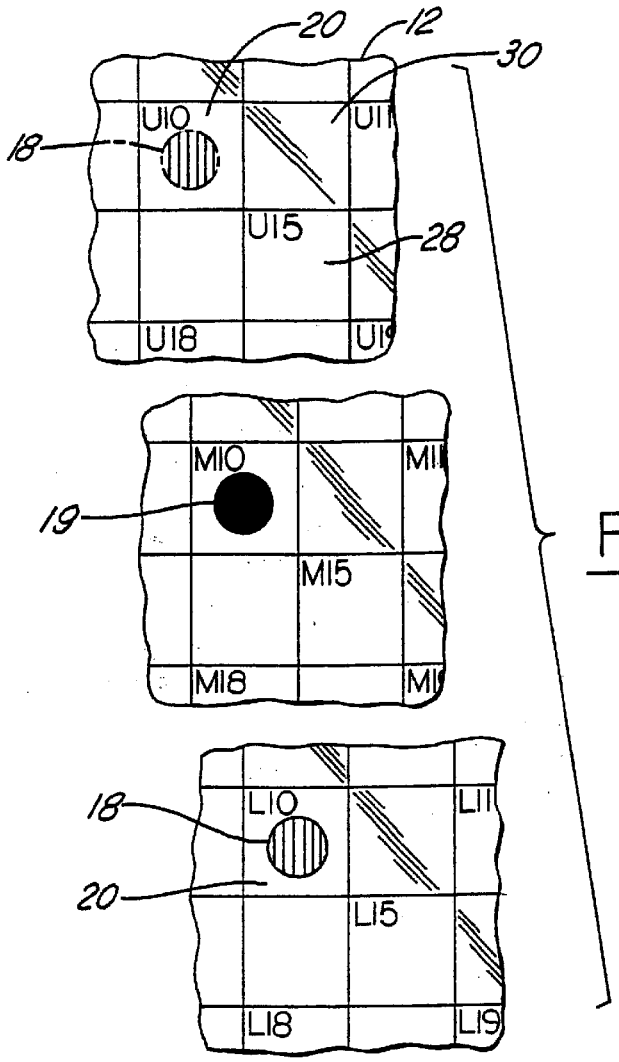

In addition, a player may make a capturing maneuver between playing levels 12, 16. Making a capturing maneuver between playing levels 12, 14, 16 requires a player to move the game piece 18 (shown only as an example) between the upper and lower levels 12, 16, provided the multi-level game board 10 has three playing levels, as best shown in FIG. 6. The player moves the game piece 18 from a playing square 20 on the upper playing level 12 to a playing square 20 on the lower playing level 16, or from a playing square 20 on the lower playing level 16 to a playing square 20 on the upper playing level 12. In either case, the game piece 18 is moved to a playing square 20 that is identically numbered to the playing square 20 from which it was moved. In order for the capturing maneuver to be initiated, the opponent must have a game piece 18, 19 on an identically numbered playing square 20 on the middle playing level 14 as that playing square 20 from which the moving player's game piece 18, 19 originated. Thus, the player making the capturing maneuver moves the game piece 18, 19 from one playing level, effectively jumping the opponent's game piece in the middle playing level 14, and positions the game piece on an identically numbered playing square 20 on a playing level (in the illustrated embodiment, the upper level 12) adjacent the opponent's game piece 18, 19. Upon making the capturing movement, the player may continue moving the game piece 18, 19 if subsequent capturing maneuvers are possible. Otherwise, the player's turn is over.

Figure 7:
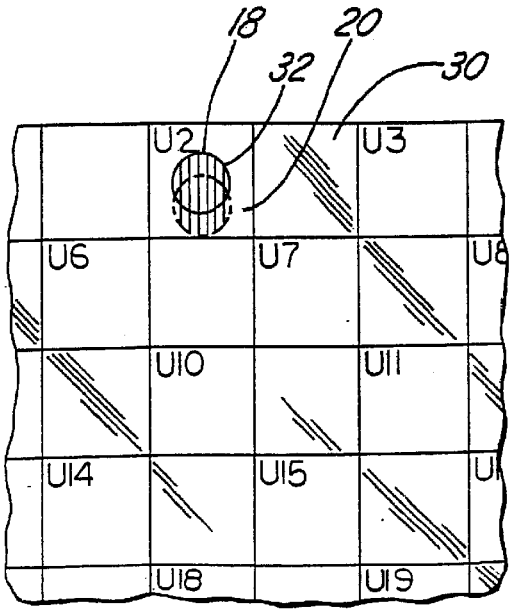

As best shown in FIG. 7, a player's game piece 18 (shown only as an example) that reaches a back row 26 on the opposite side of any playing level 12, 14, 16 is crowned "king" 32. By achieving the status of "king" 32, the player's game piece 32 may now move diagonally backward as well as diagonally forward. Typically, the "king" 32 is designated by having the opponent place a captured game piece on top of the game piece achieving the status of "king" 32 so that the "king" 32 may be readily distinguished from other game pieces 18, 19. Other than being able to move diagonally backward, the "king" 32 has the same movement provisions as the game piece had prior to achieving the status of "king" 32. It should be recognized however, that a "king" 32 can continue capturing maneuvers in a forward or backward direction as long as the capturing maneuvers are possible.

Game pieces 18 or 19 that remain in their originally set-up positions in the back rows 26 closest to each player have an obligation to make a compulsory capturing maneuver of the opponent's game piece 18 or 19 as soon as the compulsory capturing maneuver is made possible. If a player fails to make the compulsory capturing movement with a given game piece 18 or 19 in position to make such movement, the player must surrender that game piece to the opponent if the failure to move is called out by the opponent in the successive turn. It should be recognized that the compulsory movement provision may be extended to all game pieces 18 and 19 regardless of their position, and need not be restricted to those game pieces remaining in their originally set-up positions in the back rows 26 closest to each player.

Figure 8:
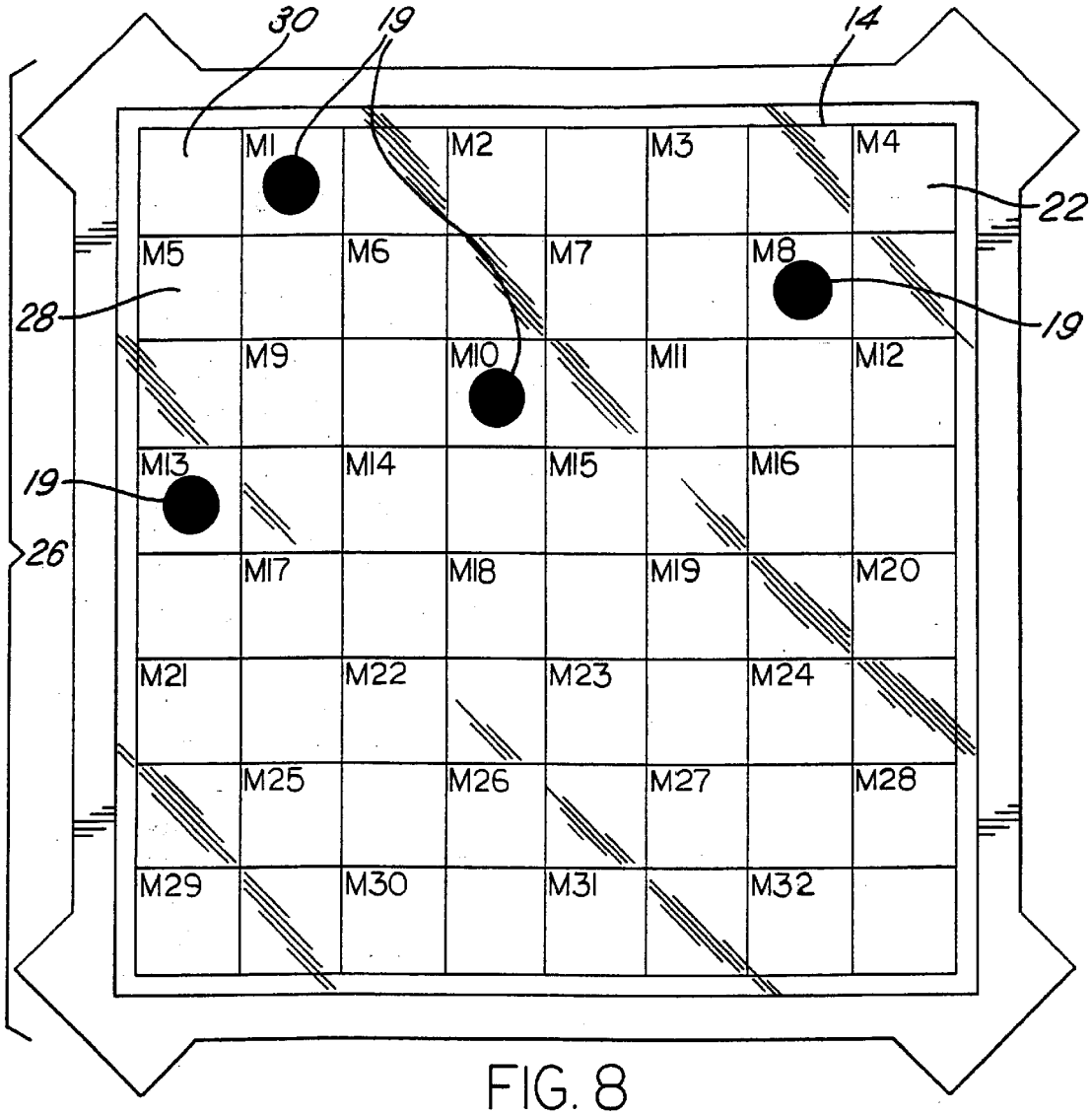
FIG. 8 shows a plan view of a playing level that is closed for diagonal movement.

A playing level 12, 14, 16 is deemed "closed" when all of the game pieces 18 or 19 of one of the players are removed from that level 12, 14, 16. When a playing level 14 is "closed", as shown by example in FIG. 8, any of the opponent's game pieces 19 that remain on the "closed" playing level 14 are restricted from moving diagonally within the "closed" playing level 14, but may be moved to another playing level 12, 16. Either player having a "king" may move the "king" in a capturing maneuver within the "closed" playing level 14. No more than two of the three levels may be "closed", such that at least one level remains open throughout the duration of the game. If there were more than three playing levels (not shown), then at least one playing level must still remain open.

Play continues until one of the players has lost all of his or her game pieces 18, 19 from every level 12, 14, 16, or is unable to move those game pieces 18, 19 that remain. In either case, the player's opponent wins the game. On occasion, in an attempt to prolong the game, it is tempting for one of the players to move the same game piece using repetitive movements over consecutive turns. However, to facilitate an end to the game that may otherwise be prolonged by repetitive movements, the movement of the game pieces is restricted to non-repetitive movements in consecutive turns.

Obviously, many modifications and variations of the preferred embodiment of the preferred invention are possible in light of the above teachings. The embodiment described only discloses a preferred possible embodiment of the invention, and it should be understood that the multi-level game board 10 as described need not be limited to the number of rows 26, number of playing squares 28, or number of playing levels 12, 14, 16 shown in the Figures. It should also be recognized that the multi-level game board 10 may be played on a computer-type apparatus, electronic game connected to a television, or the like, so that the different playing levels are represented on a display terminal (not shown). The disclosed embodiment is representative of a presently preferred form of the invention, but is intended to be illustrative rather than definitive thereof. The invention is defined in the claims.

What is claimed is:

1. A method of playing a multi-level board game, comprising:

providing at least three playing levels, each playing level constituting a separate playing surface divided into a plurality of rows, each row having a plurality of alternating playing and non-playing squares offset from the playing and non-playing squares of an adjacent row forming a diagonal between the playing squares of adjacent rows, each playing surface having an identical arrangement of playing and non-playing squares;

providing two sets of game pieces;

arranging each set of game pieces at opposite ends of said separate playing surface so that each playing surface has an identical arrangement of game pieces;

assigning non-capturing movement provisions within a playing level restricting each game piece to moving diagonally forward from a playing square to an adjacent playing square;

assigning capturing movement provisions within a playing level in which a capturing game piece is moved diagonally forward along a straight line from its initial playing square over an opponent's captured game piece positioned on an adjacent playing square to a playing square adjacent the opponent's captured game piece and removing the opponent's captured game piece from the game; and assigning non-capturing movement provisions between adjacent playing levels from each of said playing squares to an identically arranged square on an adjacent playing level and capturing movement provisions between playing levels over an opponent's game piece positioned on an identically arranged playing square of an adjacent playing level to an identically arranged playing square on a playing level adjacent the opponent's game piece.

2. The method of claim 1 including assigning crowning provisions to a given game piece that is moved to an opponent's back row of playing squares on any of said at least three playing levels, at which point said given game piece is crowned a king piece and is able to move additionally backward on the diagonal and in accordance with the non-capturing and capturing movement provisions within a given playing level.

3. The method of claim 2 including closing a level to the non-capturing and capturing movement provisions of the game pieces within the closed level when all of the game pieces of any one player are removed from said closed level, except for the king pieces which retain the capturing movement provisions within said closed level.

4. The method of claim 3 including permitting the non-capturing and capturing movement provisions of the game pieces between said closed level and an adjacent level.

5. The method of claim 3 including restricting the number of closed levels so that at least one level remains open.

6. The method of claim 2 wherein the king piece is able to make as many capturing movements in a single turn as possible in both the diagonally forward and rearward directions.

7. The method of claim 1 wherein each of said separate playing surfaces has eight of said rows, each of said eight rows having four playing squares and four non-playing squares.

8. The method of claim 7 wherein each of said at least three playing levels has twelve game pieces from each of said two sets of game pieces arranged within the first three rows of said opposite ends on said separate playing surface.

9. The method of claim 1 wherein each of said playing levels is positioned in a stacked relation so that said playing levels are directly above one another.

10. The method of claim 9 wherein each of said playing levels is constructed to be transparent.

11. The method of claim 1 wherein the two sets of game pieces are constructed so that one of the sets of game pieces is distinguishable from the other.

12. The method of claim 1 wherein the movement of the game pieces is restricted to non-repetitive movements in consecutive turns.

13. A method of playing a multi-level board game, comprising:

providing at least three playing levels, each playing level constituting a separate playing surface divided into a plurality of rows, each row having a plurality of alternating playing and non-playing squares offset from the playing and non-playing squares of an adjacent row forming a diagonal between the playing squares of adjacent rows, each playing surface having an identical arrangement of playing and non-playing squares;

providing two sets of game pieces;

arranging each set of game pieces at opposite ends of said separate playing surface so that each playing surface has an identical arrangement of game pieces;

assigning non-capturing movement provisions within a playing level restricting each game piece to moving diagonally forward from a playing square to an adjacent playing square;

assigning capturing movement provisions within a playing level in which a capturing game piece is moved diagonally forward along a straight line from its initial playing square over an opponent's captured game piece positioned on an adjacent playing square to a playing square adjacent the opponent's captured game piece and removing the opponent's captured game piece from the game;

assigning non-capturing movement provisions between adjacent playing levels to an identically arranged square on an adjacent playing level and capturing movement provisions between playing levels over an opponent's game piece positioned on an identically arranged playing square of an adjacent playing level to an identically arranged playing square on a playing level adjacent the opponent's game piece; and the game piece of a player remaining as originally set-up in a back row has a compulsory capturing movement provision to capture the game piece of the opponent when possible unless said player undertakes capturing movement provision with another game piece to capture another game piece of the opponent.

14. The method of claim 13 wherein the opponent having the game piece subject to the compulsory capturing movement provision may remove the player's game piece that failed to make the mandatory capturing maneuver unless the player undertook the capturing movement provision with said another game piece.

* * * * *